US011718816B2

(12) United States Patent
Piorkowski et al.

(10) Patent No.: US 11,718,816 B2
(45) Date of Patent: Aug. 8, 2023

(54) MICROPLASTIC-FREE, OPACIFIED LIQUID LAUNDRY DETERGENTS

(71) Applicant: Henkel AG & Co. KGaA, Duesseldorf (DE)

(72) Inventors: Daniel Thomas Piorkowski, Fairfield, CT (US); Janet Coope-Epstein, Trumbull, CT (US)

(73) Assignee: Henkel AG & Co. KGaA, Duesseldorf (DE)

( * ) Notice: Subject to any disclaimer, the term of this patent is extended or adjusted under 35 U.S.C. 154(b) by 199 days.

(21) Appl. No.: 17/102,094

(22) Filed: Nov. 23, 2020

(65) Prior Publication Data

US 2021/0155883 A1 May 27, 2021

Related U.S. Application Data

(60) Provisional application No. 62/938,707, filed on Nov. 21, 2019.

(51) Int. Cl.

| | |
|---|---|
| ***C11D 1/04*** | (2006.01) |
| ***C11D 1/22*** | (2006.01) |
| ***C11D 1/29*** | (2006.01) |
| ***C11D 1/72*** | (2006.01) |
| ***C11D 1/83*** | (2006.01) |
| ***C11D 1/831*** | (2006.01) |
| ***C11D 11/00*** | (2006.01) |
| ***C11D 17/00*** | (2006.01) |
| ***C11D 1/38*** | (2006.01) |

(52) U.S. Cl.

CPC ..... *C11D 17/0008* (2013.01); *C11D 1/29* (2013.01); *C11D 1/38* (2013.01); *C11D 1/831* (2013.01)

(58) Field of Classification Search

CPC .... C11D 1/04; C11D 1/22; C11D 1/29; C11D 1/72; C11D 1/83; C11D 1/831; C11D 11/00; C11D 17/042

See application file for complete search history.

(56) References Cited

U.S. PATENT DOCUMENTS

| | | | | |
|---|---|---|---|---|
| 3,658,552 | A | 4/1972 | Carlson et al. | |
| 5,616,781 | A | 4/1997 | Sajic et al. | |
| 5,972,869 | A | 10/1999 | Cao et al. | |
| 6,855,680 | B2 | 2/2005 | Smerznak et al. | |
| 8,901,062 | B2 | 12/2014 | De Meirleir et al. | |
| 11,441,100 | B2 * | 9/2022 | Piorkowski | C11D 1/29 |
| 2008/0214424 | A1 | 9/2008 | Barnwell et al. | |
| 2009/0143274 | A1 | 6/2009 | Benes et al. | |
| 2018/0216033 | A1 * | 8/2018 | Camire | C11D 3/046 |

FOREIGN PATENT DOCUMENTS

| | | | |
|---|---|---|---|
| EP | 3517596 | A1 | 7/2019 |
| WO | 2017030996 | A1 | 2/2017 |

OTHER PUBLICATIONS

International Searching Authority, PCT International Search Report, PCT/US2020/061878, dated Mar. 18, 2021, pp. 1-9, International Application Division, Korean Intellectual Property Office, Daejeon, Republic of Korea.

* cited by examiner

*Primary Examiner* — Brian P Mruk
(74) *Attorney, Agent, or Firm* — Bojuan Deng

(57) ABSTRACT

A microplastic-free, in-vitro opacified detergent composition includes a surfactant component present in an amount of about 8 to about 65 weight percent actives and including (1) an alcohol ethoxy sulfate having a $C_8$-$C_{20}$ backbone that is ethoxylated with from about 1 to about 10 moles of ethylene oxide, (2) at least one non-ionic surfactant having an alkoxylated alcohol, and (3) at least one anionic surfactant having a linear alkylbenzene sulfonate. The detergent composition also includes water present in a total amount of from about 5 to about 90 weight percent, free fatty acids in a total amount from about 1 to 15 weight percent and a magnesium cation in a total amount of from 0.005 to 0.3 weight percent. The composition has a turbidity value of at least 250 NTU at 75° F.

17 Claims, No Drawings

MICROPLASTIC-FREE, OPACIFIED LIQUID LAUNDRY DETERGENTS

FIELD OF THE INVENTION

The present disclosure generally relates to a detergent composition which may be a unit dose or a liquid laundry composition. More specifically, the disclosure relates to a detergent composition that includes combinations of magnesium cation, surfactants, free fatty acid, and water at particular weight ratios of actives that create an instantaneous, micro-plastic free opacification of the laundry detergent, after the magnesium cation is added. Further, this approach details methods to create a 100% biodegradable, in-process opacified liquid detergent that requires no pre-mixes or opacifying polymers.

BACKGROUND OF THE INVENTION

Opacification of laundry detergents improves the aesthetic and the perceived efficacy of the laundry detergent to the consumer. Consumers typically perceive opacified detergents as containing more active surfactant, thus are perceived to be more concentrated versus transparent detergents and appear to be of higher quality.

To opacify detergents, microplastic polymers are typically added to the liquid. These polymers provide the visual cue of mildness and improved efficacy. One embodiment of known art uses emulsified co-polymers of styrene and acrylate to impart a milky appearance in the liquid detergent. These polymers are not biodegradable and typically, consumers prefer laundry ingredients to be fully biodegradable within 28 days to minimize any negative environmental impact.

It was surprisingly found that certain combinations of magnesium cation, surfactant, water, and free fatty acids can create a stable opacification effect when mixed together. This opacification effect occurs in-vitro and within the mixing vessel and provides stable opacification for at least 3 months. Further, the materials providing the opacification effect are 100% biodegradable and can be achieved without the need of pre-mixes or opacifying polymers.

BRIEF SUMMARY OF THE INVENTION

This disclosure provides a detergent composition that includes a surfactant component present in an amount of about 7 to about 60 weight percent actives based on a total weight of the detergent composition and including (1) an alcohol ethoxy sulfate having a $C_8$-$C_{20}$ backbone that is ethoxylated with from about 1 to about 10 moles of ethylene oxide, (2) at least one non-ionic surfactant including an alkoxylated alcohol, and (3) at least one anionic surfactant including a linear alkylbenzene sulfonate. The detergent composition also includes free fatty acid, typically derived from palm kernel or coconut having a $C_{12}$-$C_{20}$ backbone present in a total amount of from about 1 to about 15 weight percent based on a total weight of the detergent composition. The detergent composition also includes water present in a total amount of from about 5 to about 85 weight percent based on a total weight of the detergent composition and a magnesium salt with the magnesium portion present in an amount of from about 0.005 to about 0.3 weight percent actives based on a total weight of the detergent composition. Further, the detergent composition has a turbidity greater than 250 NTU (Nephelometric Turbidity Units) at 75° F. and is free of any additional polymers that impart turbidity such as emulsified co-polymers of styrene and acrylate (supplied by Dow Chemical as Acusol OP301) or anionic polyester terephthalate polymer as described in EP3517596A1 (supplied by Clariant as Texcare SRA 300). Further, this composition requires no pre-mixes or time to allow for polymers to re-orientate themselves into dispersed micron-sized droplets, which impart turbidity prior to the addition to the final liquid composition (e.g. EP3517596A1).

This disclosure also provides a unit dose detergent and a unit dose detergent pack including a pouch made of a water-soluble film and the detergent composition described above that is encapsulated within the pouch. This disclosure further provides a liquid laundry detergent.

The detergent composition exhibits superior and unexpected results. More specifically, it was discovered that a particular combination of surfactants, free fatty acid, water, and magnesium cation at particular weight ratios of actives allows for the stable opacification of the detergent for over 3 months at 75° F. in both as a liquid in a bottle or as an encapsulated unit dose pack. This opacification effect only occurs after the magnesium cation is added and occurs instantaneously after all the materials are well blended. Prior to the magnesium cation addition, no material provides opacification. Further, if not enough magnesium cation or free fatty acid is added, there is no opacification effect. In addition, if too much magnesium cation or free fatty acid is added, the system destabilizes and is no longer useful for industrial applications in consumer products.

This disclosure also includes a method in which all materials except for the magnesium cation are well blended together as a transparent composition and then a sufficient amount of the magnesium cation is added as a salt to the composition (e.g. magnesium chloride), which creates an instantaneous opacification effect, which slowly increases in opacification over time and generally reaches its maximum opacity after 24 hours. This method does not require the use of specific pre-mixes, is free of polymers and is not time sensitive; to allow for polymeric components to orientate themselves to allow turbidity.

DETAILED DESCRIPTION OF THE INVENTION

The following detailed description is merely exemplary in nature and is not intended to limit the disclosure. Furthermore, there is no intention to be bound by any theory presented in the preceding background or the following detailed description.

Embodiments of the present disclosure are generally directed to detergent compositions and methods for forming the same. For the sake of brevity, conventional techniques related to detergent compositions may not be described in detail herein. Moreover, the various tasks and process steps described herein may be incorporated into a more comprehensive procedure or process having additional steps or functionality not described in detail herein. In particular, various steps in the manufacture of detergent compositions are well-known and so, in the interest of brevity, many conventional steps will only be mentioned briefly herein or will be omitted entirely without providing the well-known process details.

This disclosure provides a detergent composition that includes a surfactant component present in an amount of about 7 to about 60 weight percent actives based on a total weight of the detergent composition and including (1) an alcohol ethoxy sulfate having a $C_8$-$C_{20}$ backbone that is ethoxylated with from about 1 to about 10 moles of ethylene oxide, (2) at least one non-ionic surfactant including an alkoxylated alcohol, and (3) at least one anionic surfactant including a linear alkylbenzene sulfonate. The detergent composition also includes free fatty acid, typically derived from palm kernel or coconut having a $C_{12}$-$C_{20}$ backbone present in a total amount of from about 1 to about 15 weight percent based on a total weight of the detergent composition. The detergent composition also includes water present in a total amount of from about 5 to about 90 weight percent based on a total weight of the detergent composition and a magnesium salt with the magnesium portion present in an amount of from about 0.005 to about 0.3 weight percent actives based on a total weight of the detergent composition. Moreover, the detergent composition has a turbidity greater than 250 NTU (Nephelometric Turbidity Units) at 75° F. and is free of any additional polymers that impart turbidity.

In one aspect, the present disclosure provides a detergent composition with a consistent, stable opacification visual cue that is greater than 250 NTU or in another aspect, greater than 500 NTU, or in an additional aspect, greater than 1000 NTU. The detergent composition may be used in a unit dose pack detergent product or as a liquid laundry detergent product.

In accordance with another aspect, the present disclosure provides a method in which all materials except for the magnesium cation are well blended together as a transparent composition and then a sufficient amount of the magnesium cation is added as a salt to the composition (e.g. magnesium chloride), which creates an instantaneous opacification effect. This method is particularly useful for the industry, as transparent and opacified liquid detergents can be created from the same masterbatch (a nearly complete liquid composition with less than 3% of materials withheld for post-dosing, product differentiating materials such as fragrance and dyes), with the transparent liquid detergent having additional water added as the last step and the opacified liquid detergent having magnesium cation added as the last step. This flexibility reduces manufacturing complexity and allows differentiating products to be made from the same masterbatch.

Detergent Composition

This disclosure provides the detergent composition, first introduced above and hereinafter referred to as a composition. The composition may be, include, consist essentially of, or consist of, the surfactant component, free fatty acid, magnesium cation, and water, as each is described below, e.g. in any one or more of the amounts described in greater detail below.

In one embodiment, the composition comprises the surfactant component, free fatty acid, magnesium, and water.

In another embodiment, the composition consists essentially of the surfactant component, free fatty acid, magnesium, and water.

In still another embodiment, the composition consists of the surfactant component, free fatty acid, magnesium, and water.

In yet another embodiment, the composition comprises the surfactant component, free fatty acid, magnesium, and water, and one or more optional additives described below.

In another embodiment, the composition consists essentially of the surfactant component, free fatty acid, magnesium, and water, and one or more optional additives described below.

In another embodiment, the composition consists of the surfactant component free fatty acid, magnesium, and water, and one or more optional additives described below.

In further embodiments, the composition is free of, or includes less than 1, 0.5, 0.1, 0.05, or 0.01, weight percent of, any one or more of the optional components or additives described above or below.

Surfactant Component

As first introduced above, the composition includes the surfactant component. The surfactant component includes, is, consists essentially of, or consists of, (1) an alcohol ethoxy sulfate having a $C_8$-$C_{20}$ backbone that is ethoxylated with from about 1 to about 10 moles of ethylene oxide, (2) at least one non-ionic surfactant including an alkoxylated alcohol; and (3) at least one anionic surfactant including a linear alkylbenzene sulfonate.

In one embodiment, the surfactant component includes (1) an alcohol ethoxy sulfate having a $C_8$-$C_{20}$ backbone that is ethoxylated with from about 1 to about 10 moles of ethylene oxide, (2) at least one non-ionic surfactant including an alkoxylated alcohol; and (3) at least one anionic surfactant including a linear alkylbenzene sulfonate.

In another embodiment, the surfactant component consists essentially of (1) an alcohol ethoxy sulfate having a $C_8$-$C_{20}$ backbone that is ethoxylated with from about 1 to about 10 moles of ethylene oxide, (2) at least one non-ionic surfactant including an alkoxylated alcohol; and (3) at least one anionic surfactant including a linear alkylbenzene sulfonate.

In a further embodiment, the surfactant component consists of (1) an alcohol ethoxy sulfate having a $C_8$-$C_{20}$ backbone that is ethoxylated with from about 1 to about 10 moles of ethylene oxide, (2) at least one non-ionic surfactant including an alkoxylated alcohol; and (3) at least one anionic surfactant including a linear alkylbenzene sulfonate.

In a further embodiment, the surfactant component consists of (2) at least one non-ionic surfactant including an alkoxylated alcohol; and (3) at least one anionic surfactant including a linear alkylbenzene sulfonate and is substantially free of (1) an alcohol ethoxy sulfate.

The surfactant component is present in an amount of about 5 to about 60 weight percent actives based on a total weight of the detergent composition. In various embodiments, this amount is from about 6 to about 50, about 7.5 to about 47.5, about 7.5 to about 35, about 40 to about 47.5, about 8.5 to about 30, about 42 to about 46, etc., weight percent actives based on a total weight of the detergent composition. In various non-limiting embodiments, all values, both whole and fractional, between and including all of the above, are hereby expressly contemplated for use herein.

Alcohol Ether Sulfate

The surfactant component includes the (1) alcohol ethoxy sulfate, which may be described as an anionic surfactant. The alcohol ethoxy sulfate has a $C_8$-$C_{20}$ backbone that is ethoxylated with from about 1 to about 10 moles of ethylene oxide. Alternatively, the alcohol ethoxy sulfate may be described as having a $C_8$-$C_{20}$ backbone and about 1 to 10 moles of ethylene oxide units bonded thereto. The metal may be any metal but is typically sodium or potassium. The backbone of the surfactant component may have any number of carbon atoms from 8 to 20, e.g. 10 to 18, 12 to 16, 12 to 14, 14 to 16, or 8, 9, 10, 11, 12, 13, 14, 15, 16, 17, 18, 19, or 20, carbon atoms. Various mixtures of alcohol ethoxy sulfates may also be used wherein different length backbones are utilized. The backbone is ethoxylated with from about 1 to about 10, about 2 to about 9, about 3 to about 8, about 4 to about 7, about 5 to about 6, or 1, 2, 3, 4, 5, 6, 7, 8, 9, or 10, moles of ethylene oxide. In various non-limiting embodiments, all values, both whole and fractional, between and including all of the above, are hereby expressly contemplated for use herein.

In various embodiments, the alcohol ethoxy sulfate is further defined as sodium laureth sulfate (SLES) having the formula: $CH_3(CH_2)_{10}CH_2(OCH_2CH_2)_nOSO_3Na$ wherein n is from about 1 to about 10. In another embodiment, the alcohol ethoxy sulfate is sodium laureth sulfate ethoxylated with about 2 to about 4 moles of ethylene oxide. In various non-limiting embodiments, all values, both whole and fractional, between and including all of the above, are hereby expressly contemplated for use herein.

At Least One Non-Ionic Surfactant Including an Alkoxylated Alcohol:

The surfactant component also includes the (2) at least one non-ionic surfactant that includes, is, consists essentially of, or consists of, an alkoxylated alcohol. The terminology "at least one" means that one or more than one non-ionic surfactant may be utilized herein.

In one embodiment, the non-ionic surfactant includes an alkoxylated alcohol.

In one embodiment, the non-ionic surfactant consists essentially of an alkoxylated alcohol.

In one embodiment, the non-ionic surfactant consists of, an alkoxylated alcohol.

The alkoxylated alcohol may be a $C_8$-$C_{20}$ alcohol that is capped with (or comprises) approximately 2 to 12 moles of an alkylene oxide. In other embodiments, the alkoxylated alcohol may be an alcohol alkoxylate that has from 8 to 20, 10 to 18, 12 to 16, or 12 to 14, carbon atoms and is an ethoxylate, propoxylate, or butoxylate and is capped with an alkylene oxide, e.g. ethylene oxide, propylene oxide, or butylene oxide. The alcohol alkoxylate may be capped with varying numbers of moles of the alkylene oxide, e.g. about 2 to about 12, about 3 to about 11, about 4 to about 10, about 5 to about 9, about 6 to about 8, or about 7 to about 8, moles. In various non-limiting embodiments, all values, both whole and fractional, between and including all of the above, are hereby expressly contemplated for use herein.

At Least One Anionic Surfactant Including A Linear Alkylbenzene Sulfonate

The surfactant component also includes at least one anionic surfactant that includes, is, consists essentially of, or consists of, a linear alkylbenzene sulfonate (LAS). The terminology "at least one" means that one or more than one anionic surfactant may be utilized herein.

In one embodiment, the at least one anionic surfactant includes a linear alkylbenzene sulfonate (LAS).

In one embodiment, the at least one anionic surfactant consists essentially of a linear alkylbenzene sulfonate (LAS).

In one embodiment, the at least one anionic surfactant consists of a linear alkylbenzene sulfonate (LAS).

The linear alkylbenzene sulfonate may have a linear alkyl chain that has, e.g. 10 to 13 carbon atoms. These carbon atoms are present in approximately the following mole ratios C10:C11:C12:C13 is about 13:30:33:24 having an average carbon number of about 11.6 and a content of the most hydrophobic 2-phenyl isomers of about 18-29 wt %. The linear alkylbenzene sulfonate may be any known in the art. In various non-limiting embodiments, all values, both whole and fractional, between and including all of the above, are hereby expressly contemplated for use herein.

In one embodiment, the alcohol ethoxy sulfate is sodium laureth sulfate ethoxylated with about 2 to about 4 moles of ethylene oxide, the linear alkyl benzenesulfonate has a linear alkyl chain that has from about 10 to about 13 carbon atoms, and the alkoxylated alcohol is an ethoxylated alcohol including a $C_8$-$C_{20}$ backbone that is ethoxylated with from about 2 to about 12 moles of ethylene oxide.

In another embodiment, the (1) alcohol ethoxy sulfate is sodium laureth sulfate ethoxylated with about 2 to about 4 moles of ethylene oxide, the (2) alkoxylated alcohol is a C12-C15 alcohol ethoxylate that is capped with approximately 7 moles of ethylene oxide; and the (3) linear alkyl benzenesulfonate is 2-Phenyl Sulfonic Acid.

In a further embodiment, the (2) alkoxylated alcohol is a C12-C15 alcohol ethoxylate that is capped with approximately 7 moles of ethylene oxide; and the (3) linear alkyl benzenesulfonate is 2-Phenyl Sulfonic Acid, and the mixture is free of the (1) alcohol ethoxy sulfate.

Additional Surfactants

In other embodiments, one or more additional surfactants may be utilized and may be or include cationic, anionic, non-ionic, and/or zwitterionic surfactants, and/or combinations thereof. Additional anionic surfactants may include soaps which contain sulfate or sulfonate groups, including those with alkali metal ions as cations, can be used. Usable soaps include alkali metal salts of saturated or unsaturated fatty acids with 12 to 18 carbon (C) atoms. Such fatty acids may also be used in incompletely neutralized form. Usable ionic surfactants of the sulfate type include the salts of sulfuric acid semi esters of fatty alcohols with 12 to 18 C atoms. Usable ionic surfactants of the sulfonate type include alkane sulfonates with 12 to 18 C atoms and olefin sulfonates with 12 to 18 C atoms, such as those that arise from the reaction of corresponding mono-olefins with sulfur trioxide, alpha-sulfofatty acid esters such as those that arise from the sulfonation of fatty acid methyl or ethyl esters. In various non-limiting embodiments, all values, both whole and fractional, between and including all of the above, are hereby expressly contemplated for use herein.

Other suitable examples of additional nonionic surfactants include alkyl glycosides and ethoxylation and/or propoxylation products of alkyl glycosides or linear or branched alcohols in each case having 12 to 18 carbon atoms in the alkyl moiety and 3 to 20, or 4 to 10, alkyl ether groups. Corresponding ethoxylation and/or propoxylation products of N-alkylamines, vicinal diols, and fatty acid amides, which correspond to the alkyl moiety in the stated long-chain alcohol derivatives, may furthermore be used. Alkylphenols having 5 to 12 carbon atoms may also be used in the alkyl moiety of the above described long-chain alcohol derivatives. In various non-limiting embodiments, all values, both whole and fractional, between and including all of the above, are hereby expressly contemplated for use herein.

In other embodiments, the additional surfactant is chosen from nonionic and ionic surfactants, such as alkoxylates, polyglycerols, glycol ethers, glycols, polyethylene glycols, polypropylene glycols, polybutylene glycols, glycerol ester ethoxylates, polysorbates, alkyl ether sulfates, alkyl- and/or arylsulfonates, alkyl sulfates, ester sulfonates (sulfo-fatty acid esters), ligninsulfonates, fatty acid cyanamides, anionic sulfosuccinic acid surfactants, fatty acid isethionates, acylaminoalkane-sulfonates (fatty acid taurides), fatty acid sarcosinates, ether carboxylic acids and alkyl(ether)phosphates. In such embodiments, suitable nonionic surfactants include $C_2$-$C_6$-alkylene glycols and poly-$C_2$-$C_3$-alkylene glycol ethers, optionally, etherified on one side with a $C_1$-$C_6$-alkanol and having, on average, 1 to 9 identical or different, typically identical, alkylene glycol groups per molecule, and also alcohols and fatty alcohol polyglycol ethers, typically propylene glycol, dipropylene glycol, trimethylolpropane, and fatty alcohols with low degrees of ethoxylation having 6 to 22, typically 8 to 18, more typically 8 to 12, and even more typically 8 to 11, carbon atoms. Moreover, suitable ionic surfactants include alkyl ether sulfates, sulfosuccinic acid surfactants, polyacrylates and phosphonic acids, typically lauryl sulfate, lauryl ether sulfate, sodium sulfosuccinic acid diisooctyl ester, 1-hydroxyethane-1,1-diphosphonic acid, and diacetyltartaric esters. In various non-limiting embodiments, all values, both whole and fractional, between and including all of the above, are hereby expressly contemplated for use herein.

The one or more additional surfactants may be part of the surfactant component, as described above, or may be independent from the surfactant component. In various embodiments, the one or more additional surfactants is or includes an additional anionic surfactant and/or a non-ionic surfactant. However, other surfactants such as cationic and/or zwitterionic (amphoteric) surfactants may also be utilized or may be excluded from the composition.

Water

The detergent composition also includes water. Water is present in the composition in a total amount of from about 5 to about 90 weight percent based on a total weight of the composition. In various embodiments, the water is present in an amount of from about 8 to about 85, about 10 to about 80, or about 13, 14, 15, 16, 17, 18, 19, 20, 50, 55, 60, 65, 70, 75, 80 or 85, weight percent based on a total weight of the composition. Typically, the terminology "total amount" refers to a total amount of water present in the composition from all components, i.e., not simply water added independently from, for example, the surfactant component. In various non-limiting embodiments, all values, both whole and fractional, between and including all of the above, are hereby expressly contemplated for use herein.

Free Fatty Acid

The detergent composition also includes a free fatty acid component that may be derived from palm kernel or coconut. Suitable free fatty acid may be any fatty acid having formula: $R_3$—C(O)OH, wherein $R_3$ is a $C_5$-$C_{21}$ linear or branched aliphatic group. Preferably, the $R_3$ is a $C_{13}$-$C_{21}$ linear or branched aliphatic group. In a preferred embodiment, the fatty acid is dodecanoic acid (also known as coconut fatty acid).

Free fatty acid is present in the composition in a total amount of from about 1 to about 15 weight percent based on a total weight of the composition. In various embodiments, the free fatty acid is present in an amount of from about 1.2 to about 13, about 1.3 to about 12, or about 1.5, 2, 2.5, 3, 4, 5, 6, 7, 8, 9, 10, or 11, weight percent based on a total weight of the composition.

Magnesium Cation

The detergent composition also includes a magnesium cation component that may be derived from the following salts: magnesium chloride, magnesium sulfite, magnesium bisulfate, magnesium sulfate.

The magnesium cation is present in the composition in a total amount of from about 0.005 to about 0.3 weight percent, from about 0.005 to about 0.5 weight percent, from about 0.005 to about 1.0 weight percent, from about 0.3 to about 0.5 weight percent, from about 0.3 to about 1.0 weight percent, or from about 0.5 to about 1.0 weight percent, based on a total weight of the composition. In various embodiments, the magnesium cation is present in an amount of from about 0.01 to about 0.25, about 0.015 to about 0.15, or about 0.02, 0.04, 0.06, 0.08, 0.1, 0.125, 0.15, 0.2 or 0.225 weight percent based on a total weight of the composition.

Without being bound by theory, it is believed that the magnesium cation and the free fatty acid are interacting with one another to form stable crystal structures, that are finely dispersed throughout the entire liquid composition, giving a "milky white", opacified appearance.

Non-Aqueous Solvents

In unit laundry dose compositions, non-aqueous solvents are commonly used to maintain stable interactions between the polyvinyl alcohol film and the liquid composition. The wash composition may include at least one non-aqueous solvent in addition to the water in the composition. The non-aqueous solvent may be present in the composition from about 10 to 70, 15 to 65, 17.5 to 50 weight percent based on a total weight of the composition. Suitable non-aqueous solvents include, but are not limited to glycerine (e.g. glycerol, glycerin), propylene glycol, ethanol, polyethylene glycol 200, polyethylene glycol 300, polyethylene glycol 400, polyethylene glycol 600, polyethylene glycol 800.

Additives

The composition may include one or more of the following additives or may be free of one or more of the following additives.

Bittering agents may optionally be added to hinder accidental ingestion of the composition. Bittering agents are compositions that taste bad, so children or others are discouraged from accidental ingestion. Exemplary bittering agents include denatonium benzoate, aloin, and others. Bittering agents may be present in the composition at an amount of from about 0 to about 1 weight percent, or an amount of from about 0 to about 0.5 weight percent, or an amount of from about 0 to about 0.1 weight percent in various embodiments, based on the total weight of the composition. In various non-limiting embodiments, all values, both whole and fractional, between and including all of the above, are hereby expressly contemplated for use herein.

In other embodiments, additives may be or include neutralizers/pH adjustors just as monoethanolamine and the like, enzymes, optical brighteners, free oil fragrance, encapsulated fragrance, chelators, yellowing control agents (i.e. sodium sulfite), and combinations thereof. These additives may be chosen from any known in the art. In additional embodiments, the composition may be free of enzymes or may be including in multiple chamber unit dose products, into a chamber that is free of enzymes.

Weight Percents/Ratios of Various Component

The surfactant component, free fatty acid, water, and magnesium cation component are generally present in amounts within the weight ranges set forth above. However, in additional embodiments, these weight ranges may be narrower and/or specific weight ratios may be utilized. These weight ranges and/or ratios may be representative of embodiments that produce special, superior, and unexpected results, such as those demonstrated in the Examples. Relative to all of the paragraphs set forth immediately below, in various non-limiting embodiments, all values, both whole and fractional, between and including all of the above, are hereby expressly contemplated for use herein.

Physical Properties

Typically, liquid compositions that have greater than 10 NTU have enough turbidity to be seen by the naked eye. For detergent compositions, it is preferred to have at least 250 NTUs to ensure that it has a strong opacified effect.

For liquid detergent formulations that have at least 40% water and are typically sold to consumers in plastic bottles, it is critical for the opacify to remain distributed throughout the detergent as homogeneously as possible. Separation of the opacifier overtime such as gravitational separation (settling at the bottom of the container or rising to the top) or coagulation (particles sticking together) causes the detergent to have striated layers of varying opacity and can connotate that the detergent is unstable or expired and should not be used by the consumer.

In one embodiment, the magnesium derived opacification is stable for at least 1 week, at least 1 month, at least 3 months, at least 6 months or at least 1 year at 75° F.

In various embodiments, the NTU is greater than about 250, about 500, about 750, about 1000, about 1,500, about 2,000, about 3,000, about 4,000, about 5,000, about 7,500, about 10,000, about 15,000 at 75° F.

Method of Forming the Detergent Composition

This disclosure further provides a method of forming the detergent composition. The method includes the step of first combining the surfactant component, water, free fatty acid and optionally additives such as non-aqueous solvents, fragrance, enzymes, non-opacification polymers, or chelators. Then the magnesium cation is added in the form of a salt (e.g. magnesium chloride) to the detergent composition, which causes an instantaneous opacification effect to occur. Each of the aforementioned components may be combined in any order and in whole or partial amounts, but it is preferred for the magnesium cation to be added as the last material to the composition. All orders of addition are hereby expressly contemplated for use in various non-limiting embodiments.

Liquid Laundry Embodiment and Unit Dose Embodiment

This disclosure also provides a liquid laundry embodiment. For example, the composition may include amounts of water and/or any of the other components suitable for a liquid laundry application, as understood by those of skill in the art. For example, a liquid laundry detergent may include the surfactant component described above that is present in an amount of from about 5 to about 40 weight percent actives based on a total weight of the detergent composition, about 8 to about 35 weight percent water based on a total weight of the detergent composition, and about 9 to about 30 weight percent actives of the surfactant component based on a total weight of the detergent composition.

This disclosure also provides a unit dose embodiment. For example, the composition may include amounts of water and/or any of the other components suitable for a unit dose application, as understood by those of skill in the art. For example, a liquid laundry detergent may include the surfactant component described above that is present in an amount of from about 20 to about 65 weight percent actives based on a total weight of the detergent composition, about 25 to about 55 weight percent water based on a total weight of the detergent composition, and about 30 to about 50 weight percent actives of the surfactant component based on a total weight of the detergent composition.

Typically, the differentiating feature between the liquid laundry embodiments and the unit dose embodiment is the delivery method. A unit dose embodiment is typically encapsulated in a film, as described below whereas the liquid laundry embodiment is typically provided in a bottle for use. Further, it is commonly known in the art for the unit dose embodiment to contain less water, more non-aqueous solvent and more surfactant versus the liquid laundry embodiment due to the need of maintaining stable liquid to polyvinyl alcohol film interactions (e.g. prevention of floppy pacs, pac leakers, 2 pacs fusing together, etc.)

Unit Dose Pack

This disclosure provides a unit dose pack that includes a pouch made of a water-soluble film and the detergent composition encapsulated within the pouch, such as the unit dose embodiment described above.

A unit dose pack can be formed by encapsulating the detergent composition within the pouch, wherein the pouch includes a film. In some embodiments, the film forms one half or more of the pouch, where the pouch may also include dyes or other components. In some embodiments, the film is water soluble such that the film will completely dissolve when an exterior of the film is exposed to water, such as in a washing machine typically used for laundry. When the film dissolves, the pouch is ruptured and the contents are released. As used herein, "water soluble" means at least 2 grams of the solute (the film in one example) will dissolve in 5 liters of solvent (water in one example,) for a solubility of at least 0.4 grams per liter (g/l), at a temperature of 25 degrees Celsius (° C.) unless otherwise specified. Suitable films for packaging are completely soluble in water at temperatures of about 5° C. or greater.

In various embodiments, the film is desirably strong, flexible, shock resistant, and non-tacky during storage at both high and low temperatures and high and low humidities. In one embodiment, the film is initially formed from polyvinyl acetate, and at least a portion of the acetate functional groups are hydrolyzed to produce alcohol groups. The film may include polyvinyl alcohol (PVOH), and may include a higher concentration of PVOH than polyvinyl acetate. Such films are commercially available with various levels of hydrolysis, and thus various concentrations of PVOH, and in an exemplary embodiment the film initially has about 85 percent of the acetate groups hydrolyzed to alcohol groups. Some of the acetate groups may further hydrolyze in use, so the final concentration of alcohol groups may be higher than the concentration at the time of packaging. The film may have a thickness of from about 25 to about 200 microns (μm), or from about 45 to about 100 μm, or from about 70 to about 90 μm in various embodiments. The film may include alternate materials in some embodiments, such as methyl hydroxy propyl cellulose and polyethylene oxide. In various non-limiting embodiments, all values, both whole and fractional, between and including all of the above, are hereby expressly contemplated for use herein.

The unit dose pack may be formed from a pouch having a single section, but the unit dose pack may be formed from pouches with two or more different sections in alternate embodiments. In embodiments with a pouch having two or more sections, the contents of the different sections may or may not be the same and not all the different sections may be preferred to be opacified.

Method of Forming Unit Dose Pack

This disclosure also provides a method of forming the unit dose pack. The composition is typically first formed, e.g. using shear mixing. Shear mixing may be conducted using an over-the-head mixer such as an IKA RW 20 Digital Mixer at 500 rpm. The composition may then be encapsulated within a pouch by depositing the composition within the pouch. The pouch may then be sealed to encase and enclose the composition within the pouch to form the unit dose pack. The composition is typically in direct contact with the film of the pouch within the unit dose pack. The film of the pouch is typically sealable by heat, heat and water, ultrasonic methods, or other techniques, and one or more sealing techniques may be used to enclose the composition within the pouch.

EXAMPLES

Example 1

The following experiment was used to measure the surprising effect that Magnesium cation had to opacify a unit dose liquid laundry composition versus Sodium and Potassium cations. Composition 1 (below) was created with a 1.33% hole to add different salts of magnesium, sodium and potassium.

TABLE 1

| Material | Activity of Material | Composition 1 Weight Percent |
|---|---|---|
| Glycerine | 99+ | 12.420 |
| Propylene Glycol | 99+ | 8.206 |
| C12-C15 Alcohol Ethoxylate 7EO | 99+ | 23.074 |
| Optical Brightener | 99+ | 0.200 |
| Monoethanolamine | 99+ | 3.150 |
| Linear Alkylbenzene Sulfonic Acid | 96+ | 5.000 |
| Coconut Fatty Acid | 100 | 10.000 |
| Alcohol Ethoxy Sulfate C12-C15 3EO | 60 | 26.000 |
| Performance Polymer | 80 | 6.000 |
| Bittering Agent | 25 | 0.050 |
| DI Water | 100 | 4.567 |
| Hole (no material is added) | N/A | 1.333 |
| Total (including 1.333% hole) | | 100.000 |

Table 2 below sets forth ratios of active levels of salts that contain different cations (sodium, potassium, magnesium and calcium). Each material was postdosed separately into Composition 1 and given 24 hours prior to reading the turbidity (NTU). If the postdosed material was less than the hole of the base (1.333%), the remaining weight percent was filled with water to make the formula add to 100%. A NTU value range was measured by a Turbidity Meter (2100N Lab Turbidimeter, EPA, 115 Vac by Hach). Turbidity values below 10 are considered transparent whereas turbidity values above 1000 are considered significantly opacified.

TABLE 2

| Formula | % Active Material | % Active Cation | Material | Minimum (NTU) | Maximum (NTU) |
|---|---|---|---|---|---|
| Composition 2 | 0 | 0 | None (Negative Control) | 2 | 5 |
| Composition 3 | 0.20% | 0.04% | Sodium Sulfite (Comparative) | 2 | 5 |
| Composition 4 | 0.19% | 0.06% | Potassium Bisulfite (Comparative) | 2 | 5 |
| Composition 5 | 0.16% | 0.04% | Sodium Bisulfite (Comparative) | 2 | 5 |
| Composition 6 | 0.30% | 0.04% | Magnesium Bisulfite (Inventive) | 1520 | 2286 |

The C12-C15 Alcohol Ethoxylate is a C12-C15 Alcohol Ethoxylate that is capped with approximately 7 moles of ethylene oxide.

Linear Alkylbenzene Sulfonic Acid is 2-Phenyl Sulfonic Acid.

Alcohol Ethoxy Sulfate is C12-C15 with 3 moles of ethoxylation.

Glycerine is commercially available from Louis Dreyfus under 99.7% USP Glycerin.

Propylene Glycol is commercially available from ADM under 99+% Propylene Glycol.

Bittering Agent is commercially available from Bitrex under the tradename of Bitrex, which is a 25% active solution in water.

Performance polymer is preferred to be Sokalan HP20 (Ethoxylated Polyethyleneimine) available from BASF Compositions 2, 3, 4 and 5 produced no opacification effect, whereas Composition 6 provided a strong opacification effect due to the inclusion of magnesium cation. Compositions 7 and 8 provided no opacification and were considered unstable due to the formation of a gel. Based on Compositions 2 to 8, Sodium and Potassium cations are not able to produce an opacified effect and are not useful for this application, whereas the Magnesium cation was able to produce a very strong opacified effect greater than 1500 NTU.

Example 2

The following experiment was used to measure the different types of magnesium salts and their efficacy of opacifying a liquid unit dose composition. All materials listed in Table 3 were postdosed into Composition 1 (above) in the same manner as Table 2 (except for Composition 14, which has the full formula listed in Table 3). Water is described as QS to 100, which refers to adding water to the composition until 100 weight percent is reached.

TABLE 3

| Description | Composition 14 wt % |
|---|---|
| Glycerine | 12.353 |
| Magnesium Chloride Hexahydrate (30% active aqueous solution) | 1.97 |
| Propylene Glycol | 8.206 |
| C12-C15 Alcohol Ethoxylate 7EO | 22.185 |
| Optical Brightener | 0.200 |

TABLE 3-continued

| Description | Composition 14 wt % |
|---|---|
| Monethanolamine | 6.600 |
| Linear Alkylbenzene Sulfonic Acid | 22.203 |
| Coconut Fatty Acid | 10.000 |
| Performance Polymer | 6.000 |
| Bitrex | 0.050 |
| Water | QS to 100 |
| Total | 100 |

TABLE 4

| Formula | % Active Material | % Active Cation | Material | Minimum (NTU) | Maximum (NTU) |
|---|---|---|---|---|---|
| Composition 2 | 0 | 0 | None (Negative Control) | 2 | 5 |
| Composition 9 | 0.59% | 0.08% | Magnesium Bisulfite (Inventive) | 3328 | 3584 |
| Composition 10 | 0.88% | 0.12% | Magnesium Bisulfite (Inventive) | 3787 | 4064 |
| Composition 11 | 0.59% | 0.12% | Magnesium Sulfate (Inventive) | 1019 | 1111 |
| Composition 12 | 0.07% | 0.02% | Magnesium Chloride Hexahydrate (Inventive) | 291 | 316 |
| Composition 13 | 0.14% | 0.04% | Magnesium Chloride Hexahydrate (Inventive) | 1225 | 1430 |
| Composition 14 (Global Composition) | 0.59% | 0.08% | Magnesium Bisulfite (Inventive) | 311 | 338 |

Magnesium Chloride Hexahydrate, Magnesium Bisulfite, Magnesium Sulfate are available from VWR.

Composition 2 produced no opacification effect, whereas Compositions 9, 10, 11, 12, 13, and 14 provided a strong opacification effect independent of the magnesium cation source (Bisulfite, Sulfate, or Chloride salts).

Composition 13 was then formed into unit dose pacs by combining 20 grams of Composition 13 enclosed with 76 micron Polyvinyl Alcohol film (M8312 film by Monosol) and then placed into stability at 10 F, 40 F, 75 F, 105 F, 125 F. Pacs were checked for stability every 2 weeks for 12 total weeks (except for 125 F, which was only tested for 2 weeks). At each 2-week evaluation, the pacs were equilibrated to 75 F for 24 hours prior to evaluation. All pacs maintained opacity versus the initial measurement and showed good stability through 12 weeks (pacs did not leak, deform, or fuse).

Example 3

In a next series of Examples, a liquid laundry detergent formula was created from multiple different compositions that varied free fatty acid levels. Compositions 15 to 19 were created with a 5% hole so varying levels of Magnesium Chloride aqueous solution (30% active) could be postdosed into Compositions 15 to 19, with additional water added to bring the formula to 100 weight percent.

TABLE 5

| | | Composition | | | | |
|---|---|---|---|---|---|---|
| COMPONENT | Activity | 15 0.5% CFA Base w/w % | 16 1.5% CFA Base w/w % | 17 2.25% CFA Base w/w % | 18 3% CFA Base w/w % | 19 4.5% CFA Base w/w % |
| C12-C15 Alcohol Ethoxylate 7EO | 100.0 | 13.47 | 13.47 | 13.47 | 13.47 | 13.47 |
| Optical Brightener | 68.0 | 0.1265 | 0.13 | 0.13 | 0.13 | 0.13 |
| Di Water | 100.0 | 50.00 | 50.00 | 50.00 | 50.00 | 50.00 |
| Citric Acid | 50.0 | 4.50 | 4.50 | 4.50 | 4.50 | 4.50 |
| NaOH 50% | 50.0 | 3.08 | 3.41 | 3.61 | 3.80 | 4.43 |
| Triethanolamine | 85.0 | 0.76 | 0.76 | 0.76 | 0.76 | 0.76 |
| Linear Alkylbenzene Sulfonic Acid | 96.0 | 1.82 | 1.82 | 1.82 | 1.82 | 1.82 |
| Coconut Fatty Acid | 100.0 | 0.50 | 1.50 | 2.25 | 3.00 | 4.50 |
| Calcium Chloride | 100.0 | 0.05 | 0.05 | 0.05 | 0.05 | 0.05 |
| Betaine Surfactant | 37.5 | 2.00 | 2.00 | 2.00 | 2.000 | 2 |
| Antiredeposition Poymer | 45.00 | 0.1667 | 0.17 | 0.17 | 0.17 | 0.17 |
| Tetra Sodium Iminodisuccinate | 34.00 | 0.9559 | 0.96 | 0.96 | 0.96 | 0.96 |
| Dye | 1.0 | 1.5000 | 1.50 | 1.50 | 1.50 | 1.50 |
| Preservative | 100.0 | 0.0600 | 0.06 | 0.06 | 0.06 | 0.06 |
| Enzymes | 100.0 | 0.2000 | 0.30 | 0.30 | 0.30 | 0.30 |
| QS Water | | QI to 95% | QI to 95% | QI to 95% | QI to 95% | QI to 95% |
| Hole | N/A | 5 | 5 | 5 | 5 | 5 |
| Total | | 95.0000 | 95 | 95 | 95 | 95 |

Betaine surfactant is preferably Amphosol CG-50 available from Stepan as Cocamidopropyl Betaine.

Tetrasodium Iminodisuccinate is available from Lanxess as Baypure CX100.

Table 5 (below) shows the results when each Composition was postdosed with 0 to 1.7% of 30% Magnesium Chloride hexahydrate aqueous solution. Turbidity (NTU), Viscosity, Separation Indices, and formula stability were measured after 24 hours.

TABLE 6

| Composition of Base | Composition After Postdosing MgCl2 | % Free Fatty Acid | % MgCl2 (30% Sol'n) | Turbidity (NTU) | Turbidity Acceptable? | Viscosity (cP) | Separation Index after 0.65 hr at 855 g-force (Example 2) | Stability at Room Temp after 24 hours |
|---|---|---|---|---|---|---|---|---|
| 15 | 20 | 0.5 | 0 | 2.49 | No | 225 | Did not test | N/A |
| | 21 | | 0.45 | 3.5 | | 290 | Did not test | |
| | 22 | | 0.9 | 6.08 | | 350 | Did not test | |
| | 23 | | 1.35 | 2.26 | | 454 | Did not test | |
| | 24 | | 1.7 | | | Did not test | | |
| 16 | 25 | 1.5 | 0 | 4.9 | No | 177 | Did not test | N/A |
| | 26 | | 0.45 | 5.6 | | 234 | Did not test | |
| | 27 | | 0.9 | 512 | Yes | 402 | 0.631 | Yes |
| | 28 | | 1.35 | 1199 (preferred) | | 510 | 0.077 | |
| | 29 | | 1.7 | 1774 (preferred) | | 562 | 0.012 | |
| 17 | 30 | 2.25 | 0 | | | Did not test | | |
| | 31 | | 0.45 | 278 | Yes | 322 | Did not test | Yes |
| | 32 | | 0.9 | 1014 (preferred) | | 409 | 0.116 | |
| | 33 | | 1.35 | 1583 (preferred) | | 501 | 0.028 | |
| | 34 | | 1.7 | 2464 (preferred) | | 592 | 0.061 | |
| 18 | 35 | 3 | 0 | 228 | No | 340 | Did not test | No |
| | 36 | | 0.45 | 1386 | Yes | 440 | Did not test | |
| | 37 | | 0.9 | 2343 | | 529 | Did not test | |
| | 38 | | 1.35 | 2833 | | 633 | Did not test | |
| | 39 | | 1.7 | | | Did not test | | |
| 19 | 40 | 4.5 | 0 | 551 | No | 499 | Did not test | No |
| | 41 | | 0.45 | 1584 | Yes | 462 | Did not test | |
| | 42 | | 0.9 | 2410 | | 371 | Did not test | |
| | 43 | | 1.35 | 3217 | | 346 | Did not test | |
| | 44 | | 1.7 | | | Did not test | | |

Table 5 shows a minimum amount of Free Fatty Acid and Magnesium cation are required for opacification. Compositions 20 to 24 were unable to produce an opacification effect at 0.5% inclusion of Free Fatty Acid. Compositions 25 and 26 had enough Free Fatty Acid (due to Compositions 27, 28, and 29 being able to produce an opacified effect), but not enough Magnesium cation. At higher levels of free fatty acid inclusion, less magnesium cation was required to opacify the material such as Composition 31.

Compositions 35 to 44 (derived from compositions 18 or 19) showed that a maximum level of Free Fatty Acids can be used in a liquid laundry system as Compositions that contain greater than 3% Free Fatty Acids were not stable after 24 hours due to the opacified material settling to the bottom of the liquid composition.

After formation, each is evaluated to determine viscosity at Viscosity at 75° F., cp, using a AR2000-EX Rheometer at a shear rate of 1.08 1/s with a geometry cone of 40 mm, 1:59:49 degree:min:sec, and a truncation gap of 52 microns After formation, separation indices are measured on a LUMiSizer 12-channel instrument (manufactured by LUM). Approximately 0.4 mL of liquid composition into a 2 mm polyamide synthetic cells and spun at 855 g-force for approximately 0.65 hours at a Light Factor of 1 and at 25 degrees Celsius. Using LUM's SEPview 6 software, the separation index is determined by reading the sample cell between 115.2 mm and 129.7 mm. Separation indices range from 0 to 1.0 with 0 signifying 0% separation (completely stable) and 1.00 signifying 100% separation. Anything less than 0.2 was considered stable. This test roughly represents that amount of separation that would occur after 555.75 hours at 25 degrees Celsius at 1 g-force (i.e. standard room temperature stability). 555.75 hours is determined by multiplying 855 (the amount of g-force of the test) times the time in the test (0.65 hours). 555.75 hours is approximately 3 weeks of stability.

100 grams of Compositions 33 and 34 were put into glass jars and placed into stability testing at 10 F, 40 F, 75 F, 105 F, 125 F. Jars were checked for stability every week for 8 total weeks (except for 125 F, which was only tested for 2 weeks). At each week evaluation, the jars were equilibrated to 75 F for 24 hours prior to evaluation. All jars maintained opacity versus the initial measurement and showed good stability through at least 4 weeks.

Having now fully described this invention, it will be understood by those of ordinary skill in the art that the same can be performed within a wide and equivalent range of conditions, formulations and other parameters without affecting the scope of the invention or any embodiment thereof. All patents, patent applications and publications cited herein are fully incorporated by reference in their entirety.

The foregoing description of the specific embodiments has revealed the general nature of the invention such that others can, by applying knowledge within the skill of the art, readily modify and/or adapt for various applications such specific embodiments, without undue experimentations, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

What is claimed is:

1. A detergent composition comprising:

A. a surfactant component present in an amount of about 7 to about 60 weight percent of a total weight of said detergent composition and comprising;

(1) an alcohol ethoxy sulfate having a $C_8$-$C_{20}$ backbone that is ethoxylated with from about 1 to about 10 moles of ethylene oxide;

(2) at least one non-ionic surfactant comprising an alkoxylated alcohol;

and (3) at least one anionic surfactant comprising a linear alkylbenzene sulfonate;

B. water present in a total amount of from about 5 to about 90 weight percent of a total weight of said detergent composition; and C. a free fatty acid component present in an amount of from about 1 to about 15 weight percent of a total weight of said detergent composition, D. a magnesium cation component present in an amount of from about 0.005 to about 0.3 weight percent of a total weight of said detergent composition, wherein said detergent composition has a turbidity value greater than 250 NTU at 75° F.

2. The detergent composition of claim 1 wherein the magnesium cation is derived from magnesium chloride, magnesium sulfite, magnesium bisulfate, or magnesium sulfate.

3. The detergent composition of claim 1 wherein the composition is contained in a unit dose.

4. The detergent composition of claim 1 wherein the composition can be stably stored at room temperature between 1 and 30 months.

5. The detergent composition of claim 1 wherein the composition is free of opacifying polymers.

6. The detergent composition of claim 1 wherein the composition further comprises at least one additive ingredient selected from the group consisting of enzymes, free oil fragrance, encapsulated fragrance, chelators, and non-opacifying performance polymers.

7. A detergent composition comprising:

A. a surfactant component present in an amount of about 7 to about 35 weight percent of a total weight of said detergent composition and comprising;

(1) an alcohol ethoxy sulfate having a $C_8$-$C_{20}$ backbone that is ethoxylated with from about 1 to about 10 moles of ethylene oxide;

(2) at least one non-ionic surfactant comprising an alkoxylated alcohol; and (3) at least one anionic surfactant comprising a linear alkylbenzene sulfonate;

B. water present in a total amount of from about 40 to about 85 weight percent of a total weight of said detergent composition; and C. a free fatty acid component present in an amount of from about 1 to about 4 weight percent of a total weight of said detergent composition, D. a magnesium cation component present in an amount of from about 0.005 to about 0.3 weight percent of a total weight of said detergent composition, wherein said detergent composition has a turbidity value greater than 500 NTU at 75° F.

8. The detergent composition of claim 7 wherein the magnesium cation is derived from magnesium chloride, magnesium sulfite, magnesium bisulfite, or magnesium sulfate.

9. The detergent composition of claim 7 wherein the composition can be stably stored at room temperature between 1 and 30 months.

10. The detergent composition of claim 7 wherein the composition is free of opacifying polymers.

11. The detergent composition of claim 7 wherein the composition further comprises at least one additive ingredient selected from the group consisting of enzymes, free oil fragrance, encapsulated fragrance, chelators, and non-opacifying performance polymers.

12. A method of forming a stable, micro-plastic free opacified liquid laundry detergent, said method comprising the steps of:

A. a surfactant component present in an amount of about 7 to about 35 weight percent of a total weight of said detergent composition and comprising;

(1) an alcohol ethoxy sulfate having a $C_8$-$C_{20}$ backbone that is ethoxylated with from about 1 to about 10 moles of ethylene oxide;

(2) at least one non-ionic surfactant comprising an alkoxylated alcohol; and (3) at least one anionic surfactant comprising a linear alkylbenzene sulfonate;

B. water present in a total amount of from about 5 to about 85 weight percent based on of a total weight of said detergent composition; and C. a free fatty acid component present in an amount of from about 1 to about 15 weight percent actives based on of a total weight of said detergent composition, D. a magnesium cation component present in an amount of from about 0.005 to about 0.3 weight percent of a total weight of said detergent composition, wherein said components A, B, and C are well-mixed prior to the addition of component D; and wherein, upon the addition of component D, the detergent composition becomes instantaneously opacified with turbidity value greater than 500 NTU at 75° F.

13. The detergent method of claim 12 wherein the magnesium cation is derived from magnesium chloride, magnesium sulfite, magnesium bisulfate, or magnesium sulfate.

14. The detergent method of claim 12 wherein the composition is contained in a unit dose.

15. The detergent method of claim 12 wherein the liquid composition can be stably stored at room temperature between 1 and 30 months.

16. The detergent method of claim 12 wherein the liquid composition is free of opacifying polymers.

17. The detergent method of claim 12 wherein the liquid composition further comprises at least one additive ingredient selected from the group consisting of enzymes, free oil fragrance, encapsulated fragrance, chelators, and non-opacifying performance polymers.

* * * * *